United States Patent [19]

Fasen et al.

[11] 3,987,245

[45] Oct. 19, 1976

[54] COMPENSATED SPEAKER-MICROPHONE

[75] Inventors: Kenneth R. Fasen; Robert M. Bundus, both of Schaumburg, Ill.

[73] Assignee: Motorola, Inc., Schaumburg, Ill.

[22] Filed: Jan. 23, 1975

[21] Appl. No.: 543,585

[52] U.S. Cl. ..... 179/1 D; 179/102; 179/180

[51] Int. Cl.[2] ..... H04R 1/28; H04R 3/04

[58] Field of Search ..... 179/1 D, 1 DD, 1 H, 179/1 HF, 2 D, 37, 81 B, 101, 102, 105, 121 R, 138 R, 180; 325/16

[56] References Cited

UNITED STATES PATENTS

| | | | |
|---|---|---|---|
| 1,687,665 | 10/1928 | Hanna | 179/1 D |
| 2,518,805 | 8/1950 | Massa | 179/1 E |
| 2,535,063 | 12/1950 | Halstead | 179/1 P |

FOREIGN PATENTS OR APPLICATIONS

| | | | |
|---|---|---|---|
| 1,279,099 | 10/1968 | Germany | 179/1 D |

*Primary Examiner*—George G. Stellar
*Attorney, Agent, or Firm*—James W. Gillman; Victor Myer; Phillip Melamed

[57] ABSTRACT

A microphone which consists of a speaker having a base resonant frequency, a suppression circuit for reducing the frequency response of the speaker at the base resonant frequency, and a high pass filter for reducing the base frequency response of the speaker is disclosed. The speaker creates electrical signals in response to sound waves received and the suppression apparatus reduces the relative magnitude of the electrical signals having frequencies substantially equal to the base resonant frequency of the speaker. The high pass filter reduces the magnitude of all electrical signals having frequencies below a predetermined frequency, and thus a desired microphone frequency response is obtained.

A communications system which uses a receiver to drive a speaker in one mode of operation and uses the speaker as a microphone followed by a compensation network and a transmitter in another mode of operation is also disclosed. The compensation network consists of a base resonant suppressor apparatus for attenuating the peak response of the speaker at the resonant frequency, and a high pass filter to reduce objectionable low frequency responses of the speaker.

11 Claims, 10 Drawing Figures

COMPENSATED SPEAKER-MICROPHONE

BACKGROUND OF THE INVENTION

Systems using a single transducer element as both a speaker and a microphone are generally known in the art. In prior systems a single high pass filter has been used to sufficiently attentuate all frequencies below a predetermined frequency to obtain a desired frequency response. The transducer in such prior systems received audio sound signals including objectionable low frequency signals and after converting the audio signals to electrical signals, the objectionable frequency signals were attenuated by a single filter element. When a standard permanent magnet speaker is used as a speaker-microphone, a single high pass filter cannot sufficiently attenuate the objectionable low frequency speaker response at resonance and still maintain the presence of some low frequencies in order to produce a high fidelity (high sound quality) audio signal output.

SUMMARY OF THE INVENTION

An object of this invention is to provide an improved microphone having a high fidelity frequency response.

Another object of this invention is to provide an improved communications system using a speaker also as a microphone.

In the present invention a microphone is provided for receiving audio sound signals and developing high fidelity representative output signals in response thereto, which includes in combination: speaker means, having a base resonant frequency, for receiving input sounds at audio frequencies and developing output signals at corresponding audio frequencies in response thereto; suppression means coupled to said speaker means for reducing the magnitude of said output signals having frequencies substantially equal to said base resonant frequency relative to the magnitude of said output signals having frequencies substantially above and below said base resonant frequency; and high pass filter means coupled to said speaker means for reducing the magnitude of said output signals having frequencies below a predetermined frequency relative to the magnitude of said output signals above said predetermined frequency.

A desirable frequency response from a speaker used as a microphone is obtained by reducing the excessive speaker response to audio frequencies close to the base resonant frequency of the speaker by one apparatus, and also reducing the speaker response to all audio frequencies below a predetermined frequency by another separate apparatus.

In a communications system a receiver is connected to a speaker and when the receiver is rendered operative, by receiving a control signal, the audio frequency output of the receiver drives the speaker. The speaker is also connected to a compensation network and a transmitter. When the compensation network is rendered operative by receiving a control signal, the electrical output signals of the speaker are modified by that network to produce a high fidelity frequency response and the modified speaker output is then sent to the transmitter. When the receiver is activated, a single antenna is connected to the receiver input, and the compensation network and transmitter are disabled. When the compensation network and transmitter are rendered operative, the receiver is disabled and the single antenna is connected to the output of the transmitter. Thus a system using a single antenna and a single speaker is used for both receiving and transmitting information, while producing a high fidelity (high quality) audio signal from the speaker when it is used as a microphone.

BRIEF DESCRIPTION OF THE DRAWINGS

For a more complete understanding of the invention reference should be made to the drawings in which.

DETAILED DESCRIPTION OF THE PREFERRED EMBODIMENTS OF THE INVENTION

Figure 1:
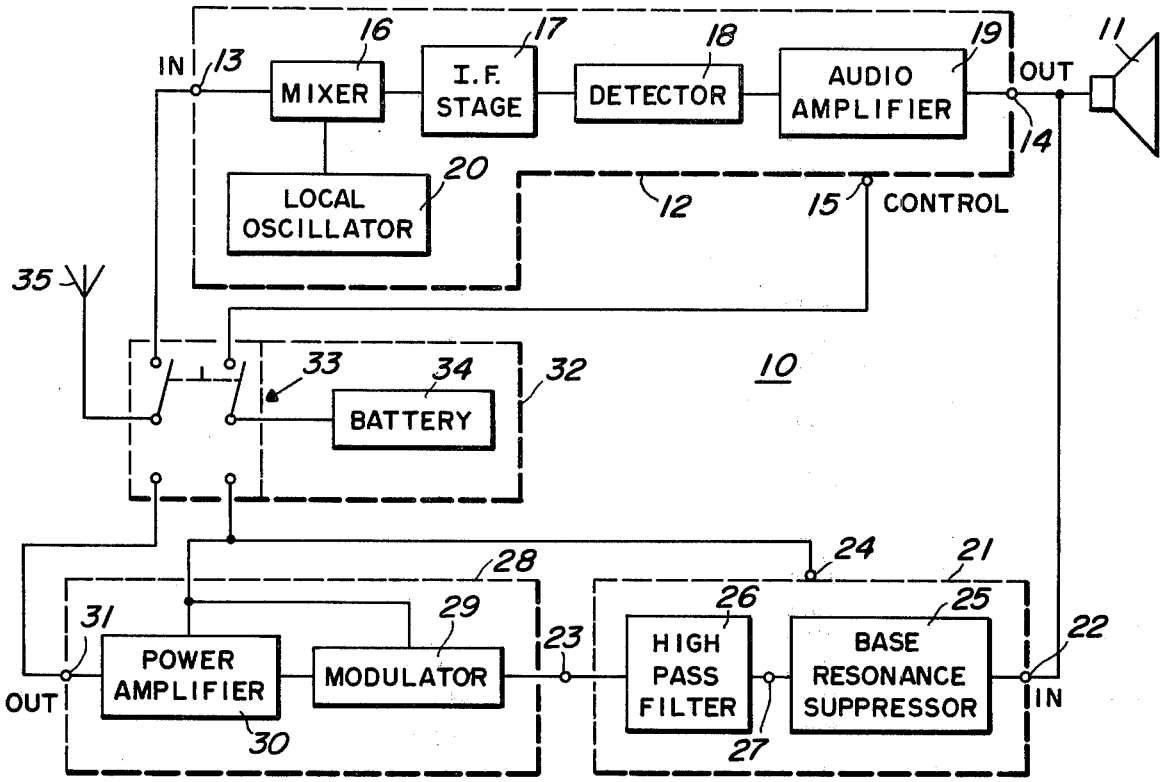
FIG. 1 is a block diagram of a communications system using a speaker-microphone and a compensation network.

Referring to FIG. 1, a communications system 10 is shown which uses a single speaker 11 as both a speaker and a microphone. A receiver 12 (shown dotted) has an input terminal 13, an output terminal 14 coupled to speaker 11, and a control terminal 15. Receiver 12 is shown as comprising a mixer 16, an IF stage 17, a detector 18, and an audio amplifier 19 all serially connected respectively between input terminal 13 and output terminal 14. A local oscillator 20 is also within receiver 12 and is shown connected to mixer 16. When a control signal is present at terminal 15, receiver 12 is rendered operative and radio frequency information signals present at terminal 13 are converted into audio frequency electrical signals at terminal 14 which subsequently drive speaker 11 and produce audio sound. Receiver 12 is a standard single conversion heterodyne radio receiver which is well known in the art.

A compensation network 21 (shown dotted) has an input terminal 22 coupled to speaker 11, an output terminal 23, and a control terminal 24. Network 21 includes a base resonant suppressor 25 connected to input terminal 22 and a high pass filter 26 connected to output terminal 23, both being also connected to an internal terminal 27. Compensation network 21 is rendered operative when a control signal is received at terminal 24. Network 21 then develops modified signals at terminal 23 in response to receiving signals at terminal 22.

A transmitter 28 (shown dotted) includes a modulator 29 connected to terminal 23 and also connected to a power amplifier 30 which is connected to an output terminal 31. Amplifier 30 and modulator 29 are connected to control terminal 24 and are rendered operative when a control signal is present at terminal 24.

A switching network 32 (shown dotted) is shown as a double pole double throw switch generally referred to as 33. A battery 34 is connected to the common terminal of one pole of switch 33 and an antenna 35 is connected to the common terminal of the other pole of switch 33. When switch 33 is in a first position, antenna 35 is connected to terminal 13 and battery 34 is connected to control terminal 15; when switch 33 is in a second position, antenna 35 is connected to output transmitter terminal 31 and battery 34 is connected to control terminal 24.

When switch 33 is in its first position, the antenna 35 receives incoming radio signals which are coupled to the input terminal of receiver 12. Then the incoming radio signals are mixed with a local oscillator frequency signal to generate an IF frequency. The IF frequency is amplified by circuit 17, the amplified signal is demodulated by circuit 18, and the audio output of detector 18 is amplified by audio amplifier 19 which creates an amplified audio electrical signal at receiver terminal 14. Receiver 12 is rendered operative since switch 33 is in its first position and battery 34 is connected to control terminal 15. Terminal 15 could supply the DC power to any stage of receiver 12, for example to amplifier 19. The internal components of receiver 12 are merely cited as an example of a typical system, but any receiver which receives information signals at an input terminal and produces audio frequency electrical signals at an output terminal when a control signal is received at a control terminal is within the scope of the invention. The electrical audio output signals at terminal 14 then drive speaker 11 which produces audio frequency sound signals. Since compensation network 21 does not receive a control signal at terminal 24 when switch 33 is in its first position, the compensation network is not activated and neither is power amplifier 30. Thus with switch 33 in its first position, communications system 10 acts as a standard radio receiver.

With switch 33 in its second position, antenna 35 is connected to transmitter output terminal 31 and battery 34 is connected to terminal 24 which therefore activates the compensation network 21 and power amplifier 30. Receiver 12 is deactivated when switch 33 is in its second position since control terminal 15 no longer receives a control signal. Speaker 11 now acts as a microphone and receives audio input sounds and develops a series of electrical output signals in response thereto at terminal 22. The activated compensation network 21 takes the electrical signals present at terminal 22 and modifies them to produce signals at terminal 23 having a desired frequency response characteristic. Suppressor 25 reduces the magnitude of output signals from speaker 11 having frequencies substantially equal to the speaker base resonant frequency relative to the magnitude of output signals having frequencies substantially above and below the resonant frequency. High pass filter 26 reduces the relative magnitude of output signals having frequencies below a predetermined frequency, i.e. the corner frequency of filter 26. Transmitter 28 then develops output information signals at terminal 31 in response to the incoming signals present at terminal 23 by first modulating a high frequency carrier with the audio signals present at terminal 23 and then by amplifying the modulated carrier frequency. Thus when switch 33 is in its second position, system 10 acts as a standard radio transmitter system.

Transmitter 28 is shown as comprising modulator 29 and power amplifier 30 as an example of typical well known components included within the transmitter 28.

The transmitter can consist of any internal components as long as audio signals are present at terminal 23 and information coded output signals are produced in response thereto at terminal 31. Power amplifier 30 and modulator 29 are shown connected to control terminal 24 so that while system 10 is in a receiver mode transmitter 28 is not activated and does not consume power.

While in the present embodiment system 10 is shown as a radio frequency communication system, other systems which retain the basic functional concepts of a receiver and transmitter are within the scope of the invention. One such system would be an electrical intercom system.

Figure 2A:
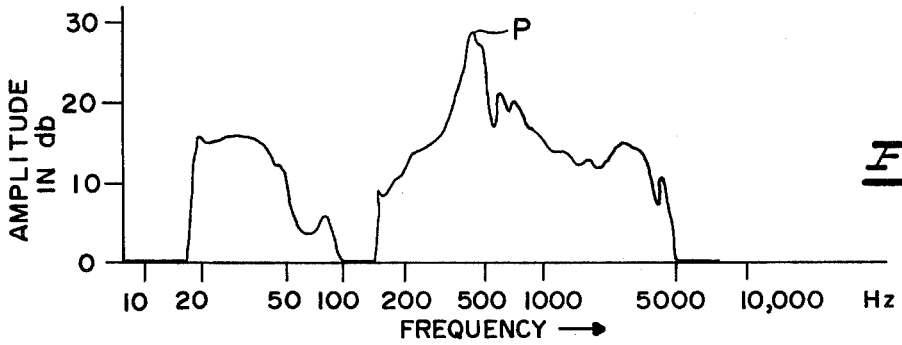
FIG. 2 is a series of graphs illustrating typical frequency responses of a speaker used as a microphone.

Referring to FIG. 2, typical frequency responses of a speaker receiving audio sound signals and producing audio electrical signals are shown. FIG. 2A shows the uncompensated electrical response characteristic of speaker 11 (shown in FIG. 1) to audio sound input signals. Thus FIG. 2A represents, by a plot of voltage signal magnitude versus frequency, the uncompensated frequency response present at terminal 22 if receiver 12 and compensation network 21 are both not activated. FIG. 2A shows a 0 db signal present from approximately 100 to 150 Hz whereupon the frequency response abruptly increases and rises to a sharp peak, P, at 400 Hz, then gradually decreases and levels off in the range of 1,000 to 4,000 Hz and subsequently falls off to zero db at frequencies above 5,000 Hz. FIG. 2A shows that speaker 11 has a large base frequency response in the range of 300 to 600 Hz relative to the mid-range response of 600 to 3,000 Hz. The peak speaker response present at 400 Hz was found to be due to the base resonant frequency of speaker 11 being equal to 400 Hz.

The response shown in FIG. 2A is unacceptable for a high fidelity microphone since a loud ringing sound would be heard at frequencies close to 400 Hz and the excessive base response in the 300 to 600 Hz range would obscure audio signals in the 600 to 3,000 Hz range.

Figure 2B:
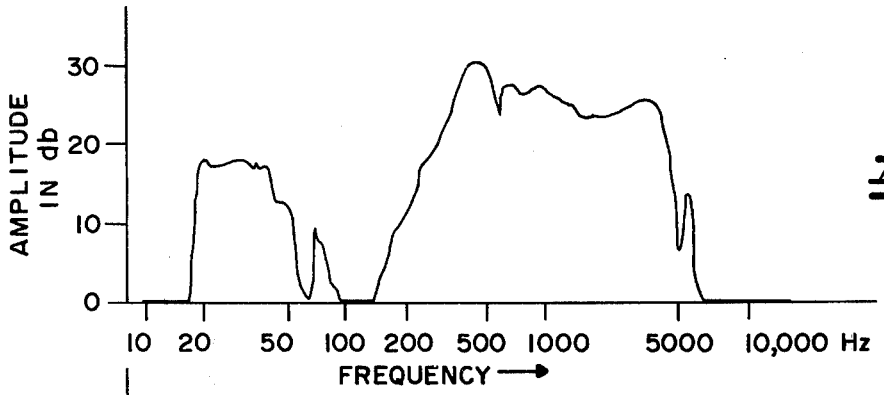

FIG. 2B shows the frequency response of system 10 (shown in FIG. 1) present at terminal 27 when compensation network 21 is activated and system 10 is operating as a transmitter. Therefore FIG. 2B shows the effect of the base resonant suppressor 25 on the electrical signals created by speaker 11 (microphone). In FIG. 2B the response is similar to FIG. 2A except that the effect of the speaker base resonant frequency on signals between 300 to 600 cycles has been reduced relative to the magnitude of signals greater than 600 cycles and less than 300 cycles. The peak P has been leveled off. Specific embodiments of base resonant suppressor 25 are shown later on, but the function of resonant suppressor 25 is to depress the base resonant peak response characteristic of speakers when they are used as microphones.

Figure 2C:
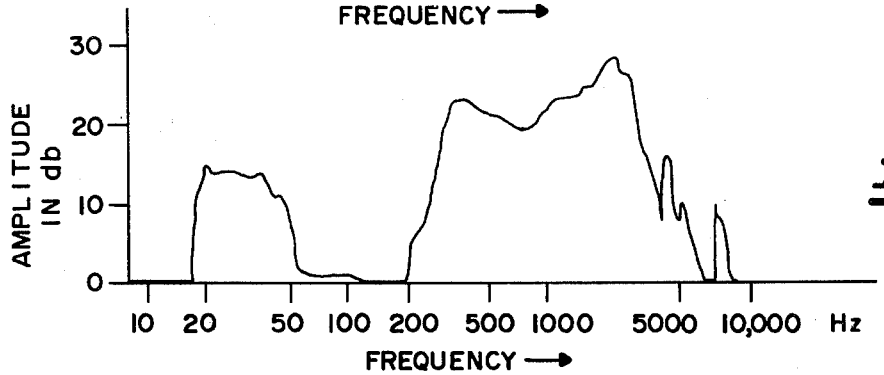

In FIG. 2C the frequency response characteristic present at terminal 23 in system 10 is shown, and thus represents the effect of high pass filter 26 on the frequency response present at terminal 27 (shown in FIG. 2B). FIG. 2C represents a high fidelity microphone frequency response wherein the base frequencies from 300 to 600 cycles have a response below the mid range response from 600 to 3,000 cycles. Thus filter 26 effectively emphasizes the mid range frequencies. High fidelity as used in this specification refers to low distortion signals which have a desired frequency distribution that is pleasing and readily intelligible to the human ear.

The base resonant suppressor 25 alone cannot obtain the desired frequency response shown in FIG. 2C, since suppressing the base resonant peak P will not reduce the magnitude of frequencies substantially below the base resonant peak. High pass filter 26 also cannot directly produce the desired frequency response shown in FIG. 2C by itself, since any attempt to suppress the base resonant frequency peak response by using just a single high pass filter will result in an excessive attenuation of frequencies below the base resonant frequency, and thus effectively eliminate all base tones, resulting in a poor qualtiy sounding microphone. It is by combining the effects of a base resonant suppressor and a high pass filter that the desired frequency response shown in FIG. 2C can be obtained from a speaker having a base resonant frequency which is used as a microphone.

Figure 3:
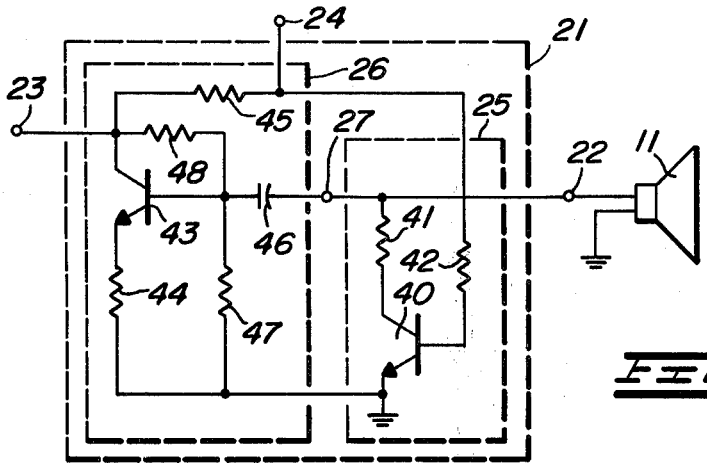
FIG. 3 is a schematic diagram of an embodiment of the compensation network and speaker-microphone shown in FIG. 1.

Referring to FIG. 3, speaker 11, having a base resonant frequency, and a specific embodiment of compensation network 21 (both shown in FIG. 1) are illustrated. Corresponding components are numbered identically in both FIGS. 1 and 3.

The speaker 11 is connected between a terminal 22 of a compensation network 21 (shown dotted) and ground and develops electrical signals between terminal 22 and ground when audio sound signals are received. Compensation network 21 has an input terminal 22, an output terminal 23, and a control terminal 24. Network 21 includes a base resonance suppressor 25 (shown dotted) connected between terminal 22 and a terminal 27, and a high pass filter 26 (shown dotted) connected between terminal 27 and terminal 23. Base resonance suppressor 25 comprises an NPN transistor 40 having its collector connected to terminal 27 through a resistor 41, its base connected to terminal 24 through a resistor 42, and its emitter connected to ground. Terminals 22 and 27 are directly connected to each other. High pass filter 26 consists of an NPN transistor 43 having its emitter connected to ground through a resistor 44, its collector connected directly to terminal 23 and through a resistor 45 to control terminal 24, and its base connected to terminal 27 through a capacitor 46, to ground through a resistor 47, and to its collector through a resistor 48.

Resistors 47 and 48 supply bias to transistor 43 and capacitor 46 and the input impedance of transistor 43 forms the high pass filter of filter 26. Transistor 43 receives its DC voltage from control terminal 24 and thus terminal 24 supplies power to high pass filter 26 when a DC signal is present at terminal 24. Transistor 40 is biased so that a DC signal present at terminal 24 will saturate transistor 40 and effectively connect resistor 41 from terminal 22 to ground. A control signal at terminal 24 will therefore cause transistor 40 to place resistor 41 in parallel with speaker 11 and thereby electrically load and dampen the base resonance of the speaker 11. Transistor 40 therefore acts as a switching relay having a control terminal (its base) and two normally open circuited contact terminals (its collector and emitter). When transistor 40 is activated, resistor 41 is directly connected in shunt with the output signals developed by speaker 11 and resistor 41 acts as a speaker load which electrically loads the speaker output impedance. By substantially loading the output impedance of speaker 11, the effect of its base resonant response is reduced since the magnitude of the resonant response is related to the speaker output impedance level and the load impedance into which it is operating. The value of resistor 41 plus any parasitic collector resistance of transistor switch 40 should typically be about one half of the nominal output impedance of speaker 11. The corner frequency of high pass filter 26 is typically 1,300 Hz. Experimentally it was found that the fidelity of the output present at terminal 23 is optimized when the base resonant frequency of speaker 11 is below 450 Hz, otherwise significant audio distortion is likely to occur. Thus a specific embodiment of compensation network 21 has been shown in FIG. 3.

Figure 4:
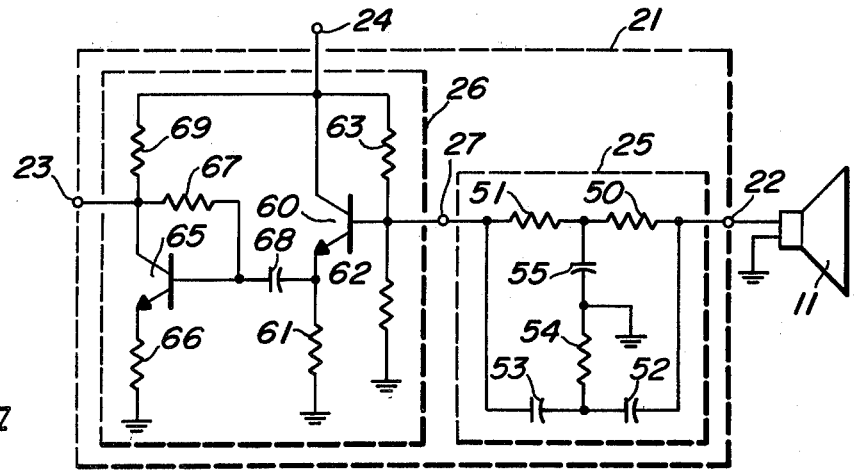
FIG. 4 is a schematic diagram of another embodiment of the compensation network and speaker-microphone shown in FIG. 1.

Referring now to FIG. 4, another specific embodiment of compensation network 21 is shown. Like components are numbered identically to the components shown in FIG. 1. Speaker 11 (having a base resonant frequency) is connected to an input terminal 22 of compensation network 21 which has an output terminal 23, a control terminal 24, a base resonant suppressor 25 connected between terminal 22 and a terminal 27, and a high pass filter 26 connected between terminals 27 and 23.

Base resonant suppressor 25 (FIG. 4) is a notch filter. Terminal 22 is connected to terminal 27 through a resistor 50 connected in series with a resistor 51, and also through a capacitor 52 connected in series with a capacitor 53. A resistor 54 is connected from ground to the junction between capacitors 52 and 53 and a capacitor 55 is connected from ground to the junction between resistors 50 and 51. Components 50 to 55 comprise a notch filter and are chosen such that the notch filter has a center frequency substantially equal to the base resonant frequency of speaker 11. Thus the notch filter reduces the base resonant peak response present at terminal 22 and presents a modified frequency response (similar to FIG. 2B) to terminal 27.

In FIG. 4 high pass filter 26 comprises an NPN transistor 60 having its collector connected to terminal 24, and its emitter connected to ground through a resistor 61. The base of transistor 60 is directly connected to terminal 27, connected to ground through a resistor 62, and connected to terminal 24 through a resistor 63. An NPN transistor 65 has its emitter connected to ground through a resistor 66, its base connected to its collector through a resistor 67 and connected to the emitter of transistor 60 through a capacitor 68, and its collector directly connected to terminal 23 and connected to terminal 24 through a resistor 69. Thus in FIG. 4 transistor 60 represents a buffer amplifier and capacitor 68 and the input impedance of transistor 65 represents a high pass filter. A buffer amplifier is required in compensation network 21 (FIG. 4) so that high pass filter 26 will not load down the notch filter shown as base resonant suppressor 25. In FIG. 4 high pass filter means 26 is switched on when a control signal is present at terminal 24.

Figure 5:
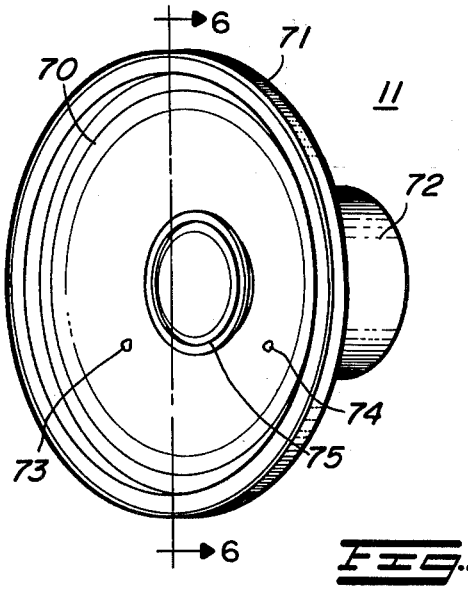
FIG. 5 is a perspective view of the front of a speaker corresponding to the speaker shown in FIG. 1.

FIG. 5 shows a front perspective view of a speaker 11 corresponding to speaker 11 shown in FIG. 1. The speaker 11 has a circular dish shaped paper cone 70 attached along its circumference to a circular dish shaped metallic holder 71 which is attached to a closed cylinder metallic housing 72. A pair of wire through connections 73 and 74 are visible in cone 70. A paper cylinder 75 is shown attached to the center of cone 70.

Figure 6:
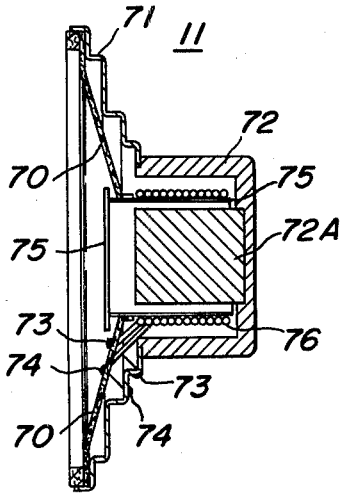
FIG. 6 is a cross sectional view of the speaker shown in FIG. 5 taken along line 6—6.

FIG. 6 shows a cross sectional view of the speaker taken along line 6—6 in FIG. 5 and all corresponding parts are numbered identically. FIG. 6 shows cylindrical housing 72 to be E shaped in cross section and also shows paper cylinder 75 (attached to paper cone 70) extending into housing 72 and surrounding a center leg 72A of E shaped cylinder 72. A winding 76 is wrapped around cylinder 75 and is connected to wire through connections 73 and 74 which are shown both on the front side of paper cone 70 and on the back side of metal holder 71. Section 72A of metal housing 72 is a permanent magnet. Thus when sound is received by speaker 11, the paper cone 70 vibrates and produces an electrical signal between terminals 73 and 74 by electromagnetic induction effects. The speaker shown in FIG. 6 will have a base resonant frequency due to its physical construction and related to the actual physical size of the speaker. The base resonant frequency of large speakers is normally in the 20 to 30 Hz range. However, for miniature speakers normally used in two way communications the base resonant frequency can occur well into the audio intelligence band of 300 to 3,000 Hz. The presence of a base resonance point within this frequency band creates a severe problem when such a speaker is used as a microphone, and thus the aforementioned electronic circuits can be used to modify the speaker output to obtain a desired microphone response characteristic.

Figure 7:
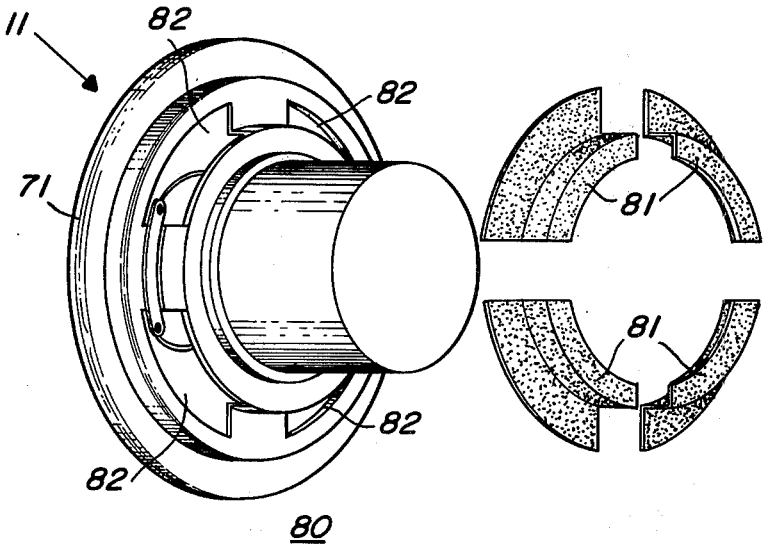
FIG. 7 is an exploded perspective view of the back of a speaker assembly which includes the speaker shown in FIG. 5.

FIG. 7 shows an exploded perspective back view of a speaker assembly 80 comprising the speaker 11 shown in FIGS. 5 and 6 and a series of pieces of masking tape 81 which are designed to fit over a series of holes 82 in metal support member 71 of the speaker. Normally the speaker has holes in metal part member 71 so that the cone 70 has a substantial amount of free air space surrounding its exterior. It has been found that by reducing the amount of free air space surrounding cone 70, the base resonant response of speaker 11, when it is used as a microphone, is severally attenuated. Thus by placing masking tape 81 over the air holes 82 in support member 71, the free air space surrounding cone 70 is reduced and the magnitude of the base resonant response of speaker 11 is attenuated relative to the magnitude of the response of the speaker at frequencies above and below the base resonant frequency. However, this means of compensation causes an overall reduction of speaker efficiency by restricting the cone excursion.

Figure 8:
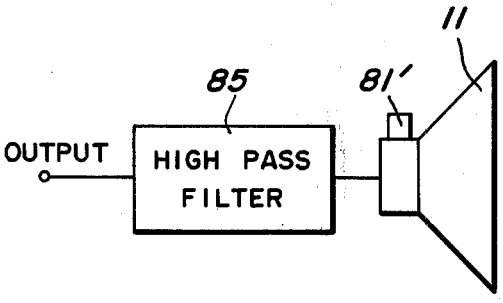
FIG. 8 is a block diagram of a compensated speaker-microphone system.

FIG. 8 shows schematically the speaker 11 used as a microphone having an acoustic loading device 81' attached to it and producing an output signal which is coupled to a high pass filter 85. Device 81' and speaker 11 in FIG. 8 correspond to masking tape 81 and speaker 11 in FIG. 7, respectively. Thus FIG. 8 represents an embodiment of a mechanically compensated speaker-microphone just as FIGS. 3 and 4 represent specific embodiments of electronically compensated speaker-microphones.

A speaker having a base resonant frequency and used as a microphone which produces a high fidelity audio response when used along with a high pass filter and a base resonant suppressor means has been disclosed. While I have shown and described specific embodiments of this invention, further modifications and improvements will occur to those skilled in the art. All such modifications which retain the basic underlying principles disclosed and claimed herein are within the scope of this invention.

I claim:

1. A microphone for receiving audio signals and developing high fidelity representative output signals within a predetermined audio frequency band in response thereto including in combination:

speaker means, having a base resonant frequency within said predetermined band, for receiving input sounds at audio frequencies and developing output signals at corresponding audio frequencies in response thereto;

suppression means coupled to said speaker means for reducing the magnitude of said output signals having frequencies substantially equal to said base resonant frequency relative to the magnitude of said output signals having frequencies substantially above and below said base resonant frequency; and high pass filter means coupled to said speaker means for reducing the magnitude of said output signals having frequencies below a predetermined frequency in said predetermined band relative to the magnitude of said output signals above said predetermined frequency.

2. The microphone according to claim 1 wherein said suppression means is mechanically coupled to said speaker means for mechanically changing the response of said speaker to sounds.

3. The microphone according to claim 2 wherein said speaker has a speaker cone having a substantial free air space surrounding the exterior thereof, and said suppression means comprises a material which reduces said free air space.

4. The microphone according to claim 1 wherein said suppression means is an electronic circuit means coupled to said speaker means and coupled in series with said high pass filter means, said speaker means has a winding and a magnet and said output signals are electrical signals produced by said speaker means across said winding.

5. The microphone according to claim 4 wherein said suppression means includes a notch filter having a center frequency substantially equal to said base resonant frequency.

6. The microphone according to claim 4 wherein said suppression means includes electronic speaker loading means for substantially resistively loading the electrical output impedance of said speaker.

7. The microphone according to claim 6 wherein said loading means includes:

a switching relay device having a control terminal, and a first and a second contact terminal which are normally substantially open circuited and substantially short circuited when a signal is received by said control terminal; and a resistor connected to one of said contact terminals, said resistor and said contact terminals being serially connected in shunt with said speaker electrical output signals.

8. A communications system comprising:

receiver means having an input and an output for receiving electrical information signals at said input and developing electrical audio frequency signals at said output;

speaker means, having a base resonant frequency, coupled to the output of said receiver means for producing audio sound signals when audio frequency electrical signals are received by said speaker, and capable of developing electrical speaker output audio frequency signals in response to audio sound signals received by said speaker;

compensation means coupled to said speaker for modifying said electrical speaker output signals including, suppression means for reducing the magnitude of said speaker output signals having frequencies substantially equal to said base resonant frequency relative to the magnitude of said speaker output signals having frequencies substantially above and below said resonant frequency, and high pass filter means for reducing magnitude of said speaker output signals having frequencies below a predetermined frequency relative to the magnitude of said speaker output signals above said predetermined frequency;

transmitter means coupled to said compensation means having an input and an output terminal for receiving said modified output signals and developing output information signals respectively;

switching means coupled to said receiver means and said transmitter and compensation means, for selectively rendering operative one of said receiver means and said transmitter and compensation means.

9. The system according to claim 8 which includes an antenna coupled to said switching means wherein said switching means contains apparatus for selectively connecting said antenna to said receiver input terminal and said transmitter output terminal.

10. The system according to claim 8 wherein said suppression circuit means includes an electronic speaker loading means for substantially resistively loading the output impedance of said speaker.

11. The system according to claim 9 wherein said suppression circuit means includes a notch filter having a center frequency substantially equal to said base resonant frequency.

* * * * *